US009651958B2

(12) United States Patent
Bansal et al.

(10) Patent No.: US 9,651,958 B2
(45) **Date of Patent: *May 16, 2017**

(54) CIRCUIT FOR REGULATING STARTUP AND OPERATION VOLTAGE OF AN ELECTRONIC DEVICE

(71) Applicant: STMicroelectronics International N.V., Amsterdam (NL)

(72) Inventors: Nitin Bansal, Gurgaon (IN); Saurabh Kumar Singh, Noida (IN); Hemant Shukla, Bangalore (IN)

(73) Assignee: STMicroelectronics International N.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/131,913

(22) Filed: Apr. 18, 2016

(65) Prior Publication Data

US 2016/0231758 A1 Aug. 11, 2016

Related U.S. Application Data

(63) Continuation of application No. 14/512,564, filed on Oct. 13, 2014, now Pat. No. 9,342,085.

(51) Int. Cl.
*G05F 1/46* (2006.01)
*G05F 1/575* (2006.01)

(52) U.S. Cl.
CPC ..... *G05F 1/468* (2013.01); *G05F 1/575* (2013.01)

(58) Field of Classification Search
CPC . G05F 1/461; G05F 1/468; G05F 1/56; G05F 1/569; G05F 1/575
See application file for complete search history.

(56) References Cited

U.S. PATENT DOCUMENTS 5,600,234 A * 2/1997 Hastings ..... G05F 1/575 323/282
5,923,211 A 7/1999 Maley et al.
5,939,870 A * 8/1999 Nguyen ..... G05F 1/575 323/282
6,246,221 B1 * 6/2001 Xi ..... G05F 1/575 323/280

(Continued)

FOREIGN PATENT DOCUMENTS

CN 205028188 U 2/2016

OTHER PUBLICATIONS

First Office Action and Search Report for co-pending CN Appl. No. 2010587901.X dated Oct. 17, 2016 (7 pages).

*Primary Examiner* — Timothy J Dole
*Assistant Examiner* — Yusef Ahmed
(74) *Attorney, Agent, or Firm* — Gardere Wynne Sewell LLP

(57) ABSTRACT

An electronic device includes a power supply, a ground, and an intermediate ground having a voltage less than a voltage of the power supply and greater than a voltage of the ground. The electronic device also includes an error amplifier having an input stage coupled between the power supply and the ground, and an output stage coupled between the power supply and the intermediate ground. A ballast transistor is coupled to receive an output from the error amplifier. A feedback circuit is coupled to an output of the ballast transistor to generate feedback signals, and the error amplifier operates in response to the feedback signals.

28 Claims, 5 Drawing Sheets

(56) References Cited

U.S. PATENT DOCUMENTS 6,703,813 B1 3/2004 Vladislav et al.
6,946,821 B2 * 9/2005 Hamon ..... G05F 1/565 323/273
6,960,907 B2 * 11/2005 Poss ..... G05F 1/575 323/273
7,199,565 B1 * 4/2007 Demolli ..... G05F 1/575 323/273
7,199,567 B2 4/2007 Eberlein
7,286,003 B2 10/2007 Chatterjee et al.
7,319,314 B1 1/2008 Maheshwari et al.
7,477,044 B2 1/2009 Eberlein
7,746,163 B2 * 6/2010 Akita ..... G11C 5/145 327/538
8,378,654 B2 2/2013 Chern et al.
2002/0130646 A1 * 9/2002 Zadeh ..... G05F 1/575 323/275
2003/0122613 A1 7/2003 Perez
2004/0140719 A1 * 7/2004 Vulih ..... H02J 9/04 307/80
2004/0178778 A1 * 9/2004 Bansal ..... G05F 1/575 323/274
2009/0309562 A1 * 12/2009 Lipcsei ..... G05F 1/56 323/282
2011/0102049 A1 * 5/2011 Conte ..... G05F 3/30 327/307
2011/0248688 A1 * 10/2011 Iacob ..... G05F 1/56 323/234
2013/0043877 A1 * 2/2013 Tang ..... H03F 1/0211 324/434
2013/0049721 A1 * 2/2013 Lo ..... G05F 1/575 323/280
2013/0113454 A1 * 5/2013 Chen ..... G05F 1/56 323/312
2013/0271228 A1 * 10/2013 Tao ..... H03L 7/183 331/18
2014/0117957 A1 * 5/2014 Usuda ..... G05F 1/575 323/280
2014/0253019 A1 * 9/2014 Wang ..... H02J 7/0052 320/107
2014/0266103 A1 * 9/2014 Wang ..... G05F 1/462 323/274
2015/0137781 A1 * 5/2015 Qu ..... G05F 1/56 323/280
2015/0188408 A1 * 7/2015 Huang ..... H02M 1/088 323/272
2015/0311787 A1 * 10/2015 Maede ..... H02M 3/156 323/271
2015/0362934 A1 * 12/2015 Usuda ..... G05F 1/575 323/280
2016/0187902 A1 * 6/2016 Zeng ..... G05F 1/575 323/280

* cited by examiner

CIRCUIT FOR REGULATING STARTUP AND OPERATION VOLTAGE OF AN ELECTRONIC DEVICE

RELATED APPLICATION

This application is a continuation of, and thus claims the benefit and priority of, U.S. application Ser. No. 14/512,564, titled "CIRCUIT FOR REGULATING STARTUP AND OPERATION VOLTAGE OF AN ELECTRONIC DEVICE", filed Oct. 13, 2014, the contents of which are incorporated by reference.

FIELD OF THE DISCLOSURE

This disclosure relates to the field of voltage regulators, and, more particularly, to a circuit for regulating voltage in an electronic device during startup of the electronic device, as well as during normal operation of the electronic device.

BACKGROUND

Handheld battery powered electronic devices such as tablets and smartphones have been in wide use in recent years, with usage rates that are ever increasing. These electronic devices may be powered off so as to conserve battery life, because insufficient battery life remains to power the device, or because the user is in an area where the use of electronic devices is prohibited.

A common type of voltage regulator used in such electronic devices is known as a low dropout (LDO) regulator, which can operate with a small input to output differential voltage, and which provides a high degree of efficiency and heat dissipation. A typical LDO regulator includes an error amplifier that controls a power field effect transistor (FET). One input of the error amplifier receives a feedback signal, while the other receives a reference voltage. The error amplifier controls the power FET so as to maintain a constant output voltage.

For a variety of reasons, it may be desirable for the error amplifier and power FET to be components having a breakdown voltage that is less than the output voltage of the LDO regulator. Such a design may present challenges when initially powered on, as a failure to provide the full reference voltage (which may not be available immediately after startup) to the error amplifier may result in the error amplifier operating beyond its breakdown voltage, which could result in negative operating characteristics.

Consequently, a LDO regulator design capable of controlling the reference voltage at startup such that the error amplifier does not operate beyond its breakdown voltage is desirable.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An electronic device is described herein. The electronic device may include a power supply node, a ground node, and an intermediate ground node having a voltage between a voltage of the power supply node and a voltage at the ground node. In addition, the electronic device may include an error amplifier having an input stage coupled between the power supply node and the ground node, and an output stage coupled between the power supply node and the intermediate ground node.

A reference voltage generator may be configured to generate a reference voltage, and an intermediate reference voltage generator may be configured to generate an intermediate reference voltage. The error amplifier may have a first input coupled to receive the reference voltage, and a second input coupled to receive the intermediate reference voltage. The error amplifier may be switchable between a startup mode wherein the error amplifier is configured to generate an output in response to the intermediate reference voltage at the second input, and a normal operation mode wherein the error amplifier is configured to generate the output in response to the reference voltage at the first input.

A voltage of the output generated when the error amplifier is in the normal operation mode may be greater than a voltage of the output generated when the error amplifier is in the startup mode.

The electronic device may include a ballast transistor having a control terminal coupled to receive the output of the error amplifier.

A feedback circuit may be configured to generate first and second feedback voltages, and the ballast transistor may have a conduction terminal coupled to the feedback circuit. The error amplifier may operate in response to the first feedback voltage during the startup mode, and may operate in response to the second feedback voltage during the normal operation mode.

The error amplifier may include a first differential input stage having differential inputs coupled to receive the reference voltage and the second feedback voltage, and with a first tail. The error amplifier may also include a second differential input stage having differential inputs coupled to receive the intermediate reference voltage and the first feedback voltage, and with a second tail. A first switch may be configured to couple the first tail of the first differential input stage to the ground node when in the normal operation mode and to decouple the tail of the first differential input stage from the ground node when in the startup mode. A second switch may be configured to selectively couple the second tail of the second differential input stage to the ground node when in the startup mode and to decouple the tail of the second differential input stage from the ground node when in the normal operation mode.

The first tail of the first differential input stage may include a current source, and the second tail of the second differential input stage may include a tail resistor.

The first differential input stage may include a first transistor having a control terminal coupled to receive the reference voltage, a first conduction terminal, and a second conduction terminal coupled to the current source. The first differential input stage may also include a second transistor having a control terminal coupled to receive the second feedback voltage, a first conduction terminal, and a second conduction terminal coupled to the current source and to the second conduction terminal of the first transistor.

The second differential input stage may include a third transistor having a first conduction terminal, a second conduction terminal coupled to the tail resistor, and a control terminal coupled to receive the intermediate reference voltage. The second differential input stage may also include a fourth transistor having a first conduction terminal, a second conduction terminal coupled to the tail resistor, and a control terminal coupled to receive the first feedback voltage.

The error amplifier may also include a fifth transistor having a first conduction terminal, a second conduction terminal coupled to the first conduction terminal of the first transistor, and a control terminal coupled to receive a biasing voltage. The error amplifier may additionally include a sixth transistor having a first conduction terminal, a second conduction terminal coupled to the first conduction terminal of the second transistor, and a control terminal coupled to receive the biasing voltage and to the control terminal of the third transistor.

The output stage may be coupled to the first and second differential input stages. The output stage may include a seventh transistor having a first conduction terminal, a second conduction terminal coupled to the intermediate ground node, and a control terminal coupled to the first conduction terminal of the seventh transistor. The output stage may also include an eighth transistor having a first conduction terminal, a second conduction terminal coupled to the intermediate ground node, and a control terminal coupled to the control terminal of the seventh transistor. The output stage may further include a ninth transistor having a first conduction terminal coupled to the power supply node, a second conduction terminal coupled to the first conduction terminal of the seventh transistor, and a control terminal. The output stage may furthermore include a tenth transistor having a first conduction terminal coupled to the power supply node, a second conduction terminal coupled to the first conduction terminal of the eighth transistor, and a control terminal.

The first tail of the first differential input stage may include a current source, and the second tail of the second differential input stage may include a tail resistor.

The output stage may be coupled to the first and second differential input stages.

The reference voltage generator may include a bandgap voltage reference circuit, and the reference voltage may be temperature independent.

The bandgap voltage reference circuit may be configured to output a control signal to indicate that the startup mode is to end and that the normal operation mode is to begin.

The electronic device may also include a logic block coupled to the bandgap voltage reference circuit and to the error amplifier, the logic block configured to switch the error amplifier between the startup mode and the normal operation mode based upon the control signal from the bandgap voltage reference circuit.

The electronic device may be a cellular phone or a tablet.

Another aspect is directed to a circuit that may include a power supply node, a ground node, and an intermediate ground node having a voltage less than a voltage of the power supply node and greater than a voltage of the ground node. The circuit may also include a first differential input stage having differential inputs coupled to receive a reference voltage and a second feedback voltage, and with a first tail. The circuit may further include a second differential input stage having differential inputs coupled to receive an intermediate reference voltage and a first feedback voltage, and with a second tail. A first switch may be configured to couple the first tail of the first differential input stage to the ground node when in a normal operation mode and to decouple the first tail of the first differential input stage from the ground node when in a startup mode. A second switch may be configured to selectively couple the second tail of the second differential input stage to the ground node when in the startup mode and to decouple the second tail of the second differential input stage from the ground node when in the normal operation mode. An output stage may be coupled between the power supply node and the intermediate ground node, and coupled to outputs of the first and second differential input stages.

A method aspect is directed to a method of operating an electronic device that may include coupling an input stage of an error amplifier between a power supply node and a ground node, and coupling an output stage of the error amplifier between the power supply node and an intermediate ground node having a between a voltage of the power supply and a voltage of the ground. The error amplifier may be switched between a startup mode wherein the error amplifier is configured to generate an output in response to an intermediate reference voltage, and a normal operation mode wherein the error amplifier is configured to generate an output a normal operation voltage in response to a reference voltage.

DETAILED DESCRIPTION

Figure 1:
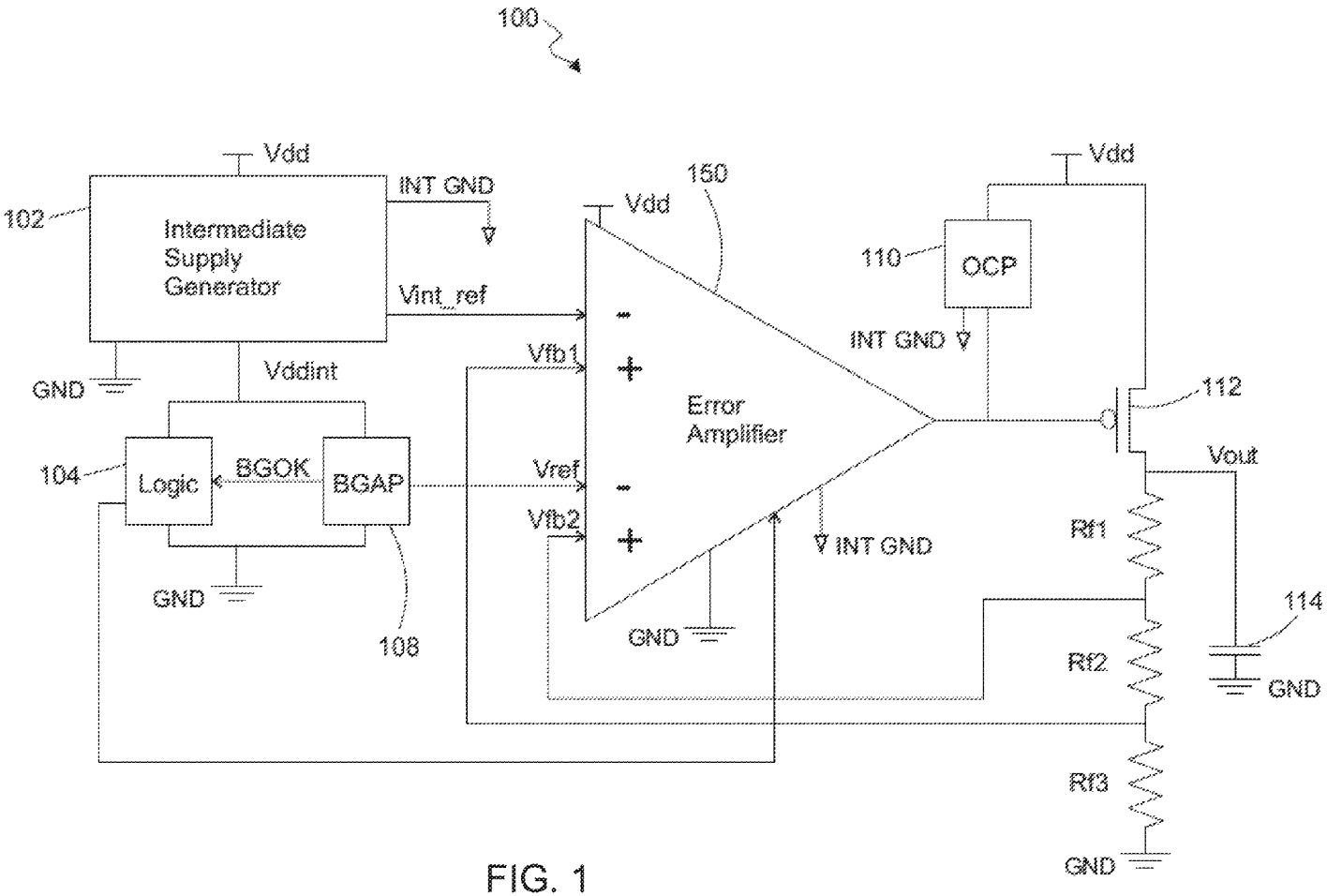
FIG. 1 is a schematic diagram of a voltage regulator device in accordance with this disclosure.

One or more embodiments of the present disclosure will be described below. These described embodiments are only examples of the presently disclosed techniques. Additionally, in an effort to provide a concise description, all features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. When referring to transistors, it should be noted that the terms "first conduction terminal" and "second conduction terminal" do not refer to structure or biasing, and are instead merely labels. "First conduction terminal" is used to denote the conduction terminal of a transistor that is closest to the top of the page of the drawing figure on which it appears, while "second conduction terminal" is used to denote the conduction terminal of a transistor that is closest to the bottom of the page of the drawing figure on which it appears. The terms "first conduction terminal" and "second conduction terminal" may each be referring to a source or drain, and this need not be consistent between transistors. For example, the "first conduction terminal" of one transistor may be a source, while the "first conduction terminal" of another transistor may be a drain.

With reference to FIG. 1, a voltage regulator 100 for an electronic device is now described. The electronic device may be a tablet, smartphone, smart watch, or any suitable device, and may be powered by a battery (not shown) in some applications. The voltage regulator 100 may be configured as a low drop out regulator. The power supply Vdd which serves as input to the voltage regulator 100 may have a voltage greater than the breakdown voltages of various components of the voltage regulator, and the output from the voltage regulator may have a voltage greater than the breakdown voltages of the various components. The design of the voltage regulator 100 is able to tolerate these voltages because it limits the voltage swing between the input and output such that the voltage across the voltage regulator does not exceed the breakdown voltages of the various components.

The voltage regulator 100 includes an intermediate supply generator 102 that is coupled between a power supply Vdd and ground GND. The intermediate supply generator 102 is configured to output an intermediate ground INT GND (referred to as a raised ground) having a voltage less than a voltage of the power supply Vdd (approximately, in an example, equal to one-half of Vdd), and greater than a voltage of the ground GND. The intermediate supply generator 102 is also configured to generate an intermediate reference voltage Vint_ref, and an intermediate power supply voltage Vddint (approximately, in an example, equal to one-half of Vdd). A logic block 104 and a reference voltage generator 108 (illustratively a bandgap reference generator) are coupled to the intermediate supply generator 102 to receive the intermediate power supply voltage Vddint and are also coupled to ground GND. The reference voltage generator 108 is configured to generate a temperature independent reference voltage Vref that is greater than the intermediate reference voltage Vint_ref.

The voltage regulator 100 also includes an error amplifier 150 having an input stage coupled between the power supply Vdd and the ground GND, and an output stage coupled between the power supply Vdd and the intermediate ground INT GND. The coupling of the output stage between the power supply and the intermediate ground INT GND helps to reduce the voltage swing of the output from the output stage, and thus the voltage swing of the output of the voltage regulator 100. By reducing the voltage swing of the output of the voltage regulator 100, electrical stresses on the various components can be reduced, as the voltage across the voltage regulator can be kept from exceeding the breakdown voltage of the various components of the voltage regulator.

The error amplifier 150 has an input coupled to the reference voltage generator 108 to receive the reference voltage Vref, and an input coupled to the intermediate supply generator 102 to receive the intermediate reference voltage Vint_ref. The error amplifier 150 is switchable between a startup mode wherein the error amplifier is configured to output a startup voltage based on a difference between a first feedback voltage Vfb1 and the intermediate reference voltage Vint_ref, and a normal operation mode wherein the error amplifier is configured to output a normal operation voltage based on a difference between a second feedback voltage Vfb2 and the reference voltage Vref. The error amplifier 150 controls a ballast transistor 112 via the control terminal thereof, and the ballast transistor outputs an output voltage Vout. Due to the error amplifier 150 operating based upon the intermediate ground INT GND, the control terminal of the ballast transistor 112 is kept from seeing a voltage of zero, which helps ensure that the ballast transistor is not fully turned on. The use of a single ballast transistor 112 to power the load saves space in an integrated circuit over designs which use other ballast arrangements, such as a cascade ballast that involves multiple such transistors.

The ballast transistor 112 has a first conduction terminal coupled to the power source Vdd and a second conduction terminal coupled to a load (not shown). A load capacitor 114 is coupled in parallel with the load. In addition, the second conduction terminal of the ballast transistor 112 is coupled to a feedback network of three resistors Rf1, Rf2, Rf3. The feedback network resistors Rf1, Rf2, Rf3 are coupled in a series arrangement as a voltage divider circuit so as to generate the first and second feedback voltages Vfb1, Vfb2.

The load capacitor 114 is kept charged during operation of the voltage regulator 100. However, the load capacitor 114 discharges when the electronic device (and thus the voltage regulator 100) is powered off. Therefore, when the electronic device is powered on, the load capacitor 114 could pull a large initial current from the ballast transistor 112 until it is charged. Conducting this large initial current could damage the ballast transistor 112. So as to avoid this potential issue, an over current protection circuit 110 is coupled between the first conduction terminal of the ballast transistor 112 (at the power source Vdd) and the control terminal of the ballast transistor. The over protection circuit 110 is also coupled to the intermediate ground INT GND, and alters the voltage at the gate of the ballast transistor 112 so as to limit the current conducted through the conduction terminals of the ballast transistor.

Figure 4:
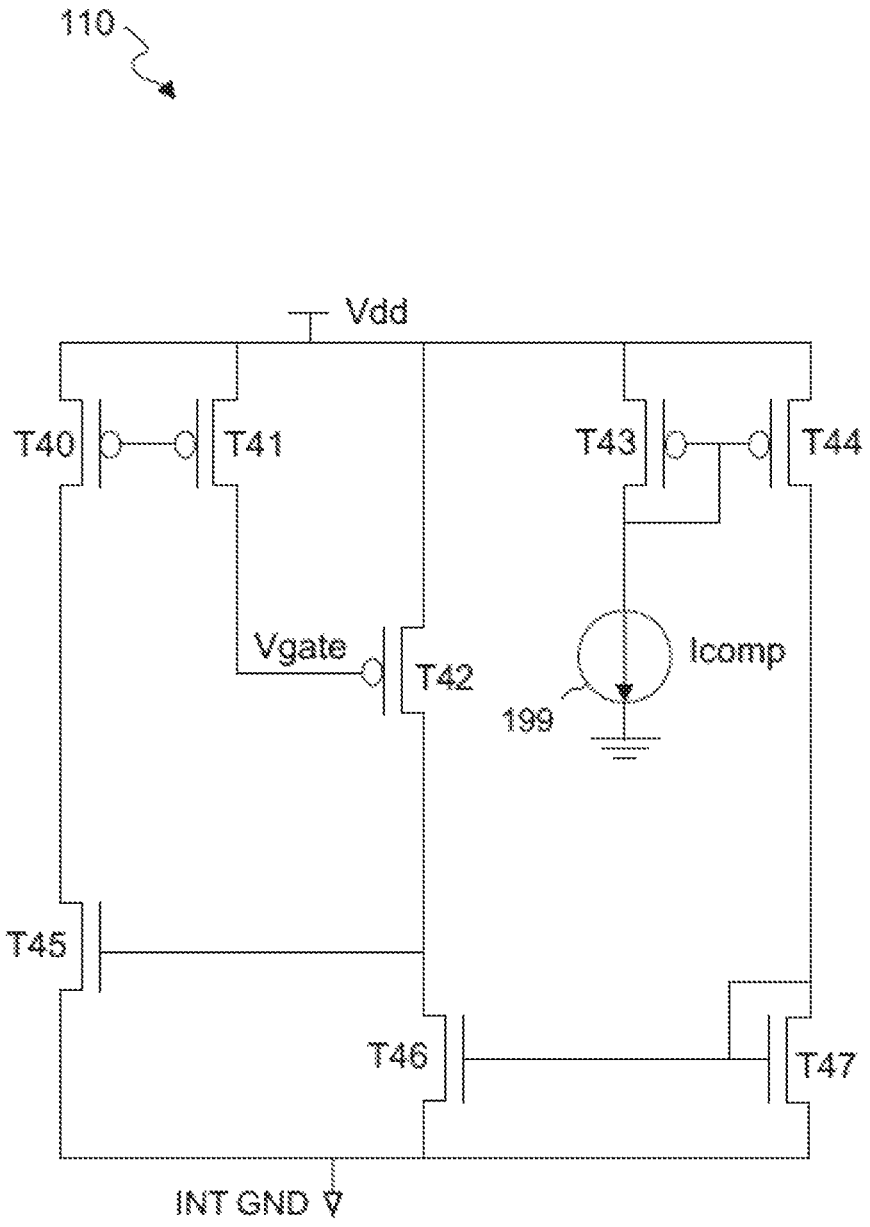
FIG. 4 is a schematic diagram of an over current protection circuit for use in the device of FIG. 1.

The over protection circuit 110, shown in FIG. 4, compares the current conducted through the conduction terminals of the ballast transistor 112 with a fixed comparison current Icomp, and alters the voltage Vgate at the control terminal of the ballast transistor so as to limit the current conducted through the conduction terminals.

In greater detail, the transistor T42 replicates the current flowing through the ballast transistor 112. The current mirror formed by the transistors T43 and T44 mirrors Icomp to the current mirror formed by the transistors T46 and T47, which in turn mirrors Icomp such that it is compared to the replicated current flowing through the transistor T42. If the ballast transistor 112 is drawing a current larger than Icomp, the over protection circuit 110 operates such that the current flowing through transistor T40 increases. The transistor T41 mirrors the current flowing through the transistor T40, which pulls up Vgate.

Referring again to FIG. 1, as will be explained in detail below, the error amplifier 150 has two pairs of inputs. One pair of inputs receives the intermediate reference voltage Vint_ref and the first feedback voltage Vfb1, while the other pair receives the reference voltage Vref and second feedback voltage Vfb2.

The reference voltage generator 108, in addition to generating the reference voltage Vref, also generates a control signal which indicates that the startup mode is to end and the normal operation mode is to begin. The logic block 104 receives this control signal, and operates to switch the error amplifier 150 between the startup mode and the normal operation mode. Startup mode is used for a period of time after startup of the electronic device, and normal operation mode is used thereafter.

During startup, the reference voltage Vref, as a fixed regulated voltage value output from the reference voltage generator 108, is not immediately available due to switching delays of the transistors in the reference voltage generator, however the intermediate reference voltage Vint_ref is available as the intermediate supply generator 102 does not employ transistors in the generation of the intermediate reference voltage. Therefore, during the startup mode, the logic block 104 controls the error amplifier 150 so as to operate based upon the pair of inputs that receive the intermediate reference voltage Vint_ref and the first feedback voltage Vfb1. This serves to control the error amplifier 150 such that it outputs the startup voltage. This startup voltage, as applied to the control terminal of the ballast transistor 112, produces an output voltage Vout that is safe for the ballast transistor. When the reference voltage Vref is available from the reference voltage generator 108, the reference voltage generator sends a signal BGOK to the logic block 104 to alert it that the reference voltage is available. The logic block 104 then controls the error amplifier 150 to operate based upon the pair of inputs that receive the reference voltage Vref and the second feedback voltage Vfb2. Based upon these inputs, the error amplifier 150 outputs the normal operation voltage. The normal operation voltage, as applied to the control terminal of the ballast transistor 112, serves to increase the output voltage of the ballast transistor to the final output voltage Vout. Since this increase is from the safe output voltage and not from zero, the voltage across the ballast transistor 112 remains safe during the ramp up.

Figure 2:
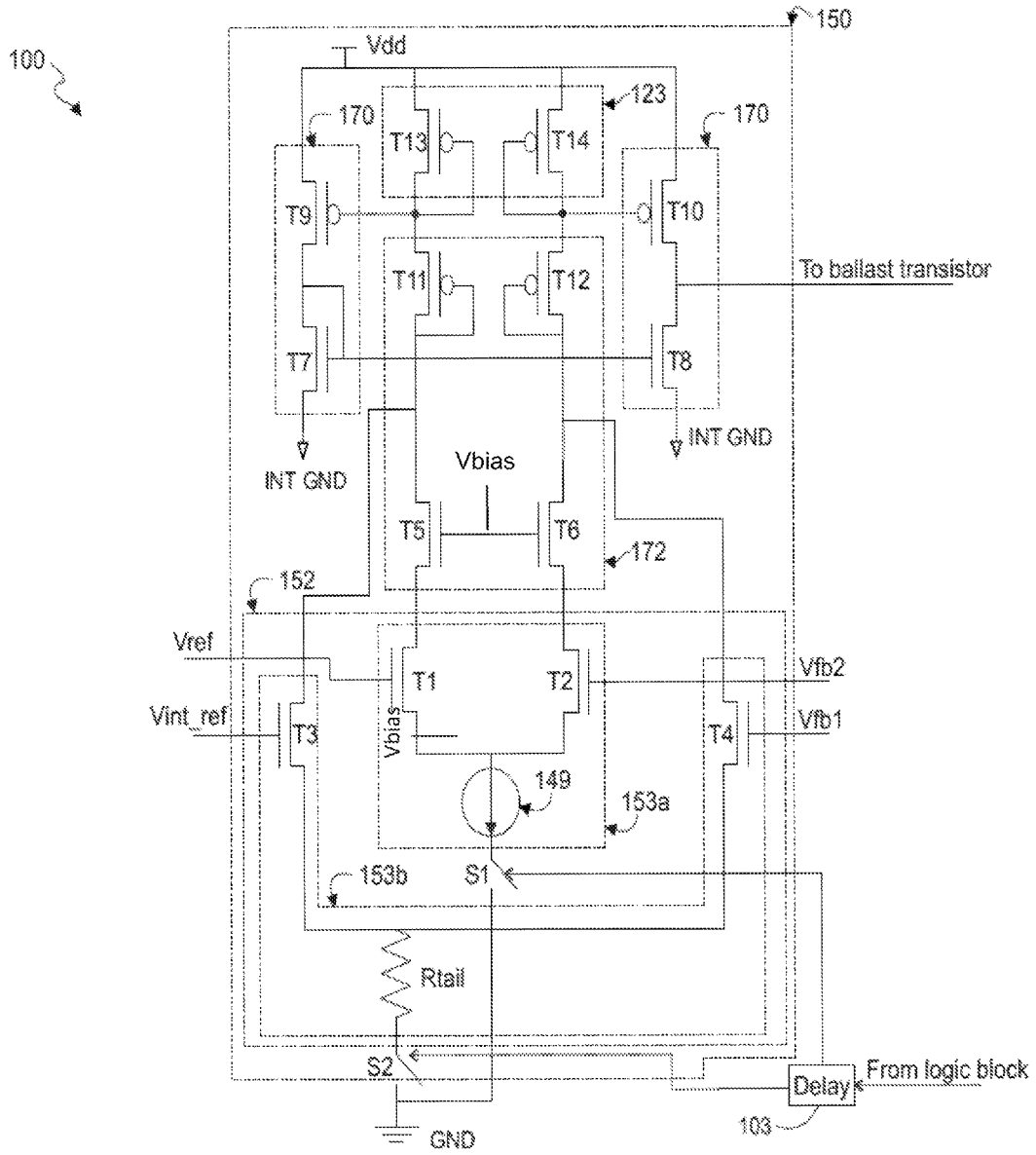
FIG. 2 is a schematic diagram of an error amplifier for use with the device of FIG. 1.

With reference to FIG. 2, the error amplifier 150 is now described in greater detail. The error amplifier 150 includes an input stage, which is comprised of first and second differential input stages 153*a*, 153*b*.

The first differential input stage 153*a* has differential inputs coupled to the reference voltage Vref and the second feedback voltage Vfb2. The second differential input stage 153*b* has differential inputs coupled to the intermediate reference voltage Vint_ref and the first feedback voltage Vfb1. A first switch S1 couples the tail of the first differential input stage 153*a* to ground GND when in the normal operation mode, and decouples the tail of the first differential input stage from ground GND in the startup mode. This deactivates the first differential input stage 153*a* during the startup mode, and activates the first differential input stage 153*a* during the normal operation mode. The switch S1 is controlled by the logic block 104, as described above.

A second switch S2 couples the tail of the second differential input stage 153*b* to ground GND when in the startup mode and decouples the tail of the second differential input stage from the ground when in the normal operation mode. This deactivates the second differential input stage 153*b* during the normal operation mode, and activates the second differential input stage during the startup mode. The logic block 104 controls the switch S2, as described above.

In greater detail, the first differential input stage 153*a* is constructed from first and second transistors T1, T2. The control terminals of the transistors T1, T2 are coupled to the reference voltage Vref and the second feedback voltage Vfb2, respectively. Thus, the control terminals of the transistors T1, T2 are the differential inputs of the first differential input stage 153*a*. The first conduction terminals of the transistors T1, T2 are coupled to second conduction terminals of transistors T5, T6, respectively, which will be described in detail below. The second conduction terminals of the transistors T1, T2 are coupled to a current source 149, which makes up the tail of the first differential input stage 153*a*. Therefore, the first switch S1 couples the current source 149 to ground GND when the error amplifier 153*a* is in the normal operation mode, and decouples the current source from ground when the error amplifier is in the startup mode.

The second differential input stage 153*b* is constructed from third and fourth transistors T3, T4. The control terminals of the transistors T3, T4 are coupled to the intermediate reference voltage Vint_ref and the first feedback voltage Vfb1, respectively. Therefore, the control terminals of the transistors T3, T4 are the differential inputs of the second differential input stage 153*b*. The first conduction terminals of the transistors T3, T4 are coupled to first conduction terminals of transistors T5, T6, as well as to second conduction terminals of transistors T1, T12, respectively, as will be described in detail below. The second conduction terminals of the transistors T3, T4 are coupled to a tail resistor Rtail, which makes up the tail of the second differential input stage 153*b*. Thus, the second switch S2 couples the tail resistor Rtail to ground GND when the error amplifier 150 is in the startup mode, and decouples the tail resistor from the ground when the error amplifier is in the normal operation mode.

The logic block 104 (of FIG. 1) controls the switches S1, S2 based upon the signal BGOK from the reference voltage generator indicating that the reference voltage is available, so as to switch over from the second differential input stage 153*b* and startup mode to the first differential input stage 153*a* and normal operation mode. A delay block 103, which is coupled to receive output of the logic block 104 (of FIG. 1), delays the startup of a given differential input stage until the other is active so as to avoid a situation where both differential input stages 153*a*, 153*b* are off.

A cascode stage 172 serves to protect the transistors T1, T2, T3, T4 from stress. The cascode 172 includes fifth and eleventh transistors T5, T11 in a cascode configuration, and sixth and twelfth transistors T6, T12 in a cascode configuration. The control terminals of the transistors T5, T6 are coupled to a biasing voltage Vbias which is the voltage across the resistors R2, R3 (in series). The first conduction terminals of the transistors T5, T6 are coupled to the second conduction terminals of the transistors T11, T12, respectively, while the second conduction terminals of the transistors T5, T6 are coupled to the first conduction terminals of the transistors T1, T2, respectively. The first conduction terminal of the transistor T5 is also coupled to the first conduction terminal of the transistor T3, while the first conduction terminal of the transistor T6 is also coupled to the first conduction terminal of the transistor T4. The control terminals of the transistors T11, T12 are coupled to the second conduction terminals of the transistors T11, T12, respectively, while first conduction terminals of the transistors T11, T12 are coupled to second conduction terminals of transistors T13, T4, which will be described in detail below.

An output stage 170 is coupled to, and controlled by, the first and second differential input stages 153*a*, 153*b*, and serves to generate the startup voltage and the normal operation voltage. The output stage 170 is coupled between the power supply Vdd and the intermediate ground INT GND.

The output stage 170 is constructed from seventh, eighth, ninth, and tenth transistors T7, T8, T9, T10. The first conduction terminal of the transistor T9 is coupled to the power source Vdd, while the second conduction terminal of the transistor T9 is coupled to the first conduction terminal of the transistor T7. The control terminal of the transistor T9 is coupled to the second conduction terminal of transistor T13, as well as to the first conduction terminal of transistor T11, as will be described below. The second conduction terminal of the transistor T7 is coupled to the intermediate ground INT GND, and the control terminal of the transistor T7 is coupled to the control terminal of the transistor T8, as well as to the first conduction terminal of the transistor T7.

The first conduction terminal of the transistor T10 is coupled to the power supply Vdd, while the second conduction terminal of the transistor T10 is coupled to the first conduction terminal of the transistor T8. The control terminal of the transistor T10 is coupled to a second conduction terminal and control terminal of transistor T14, and a first conduction terminal of transistor T12 as will be described below. The second conduction terminal of the transistor T8 is coupled to the intermediate ground INT GND. The control terminals of T7 and T8 are coupled together, and to the first conduction terminal of T7.

An active load stage 173 is coupled to the output stage 170, and serves to adjust the gain of the output stage by acting as a tunable, nonlinear resistor. The active load stage includes the transistors T13, T14. The control terminals of the transistors T13, T14 are coupled to the control terminals of T9, T10, respectively, as well as to their own second conduction terminals. The first conduction terminals of the transistors T13, T14 are coupled to the power source Vdd, while the second conduction terminals of the transistors T13, T14 are coupled to the first conduction terminals of transistors T11, T12, respectively.

Figure 3A:
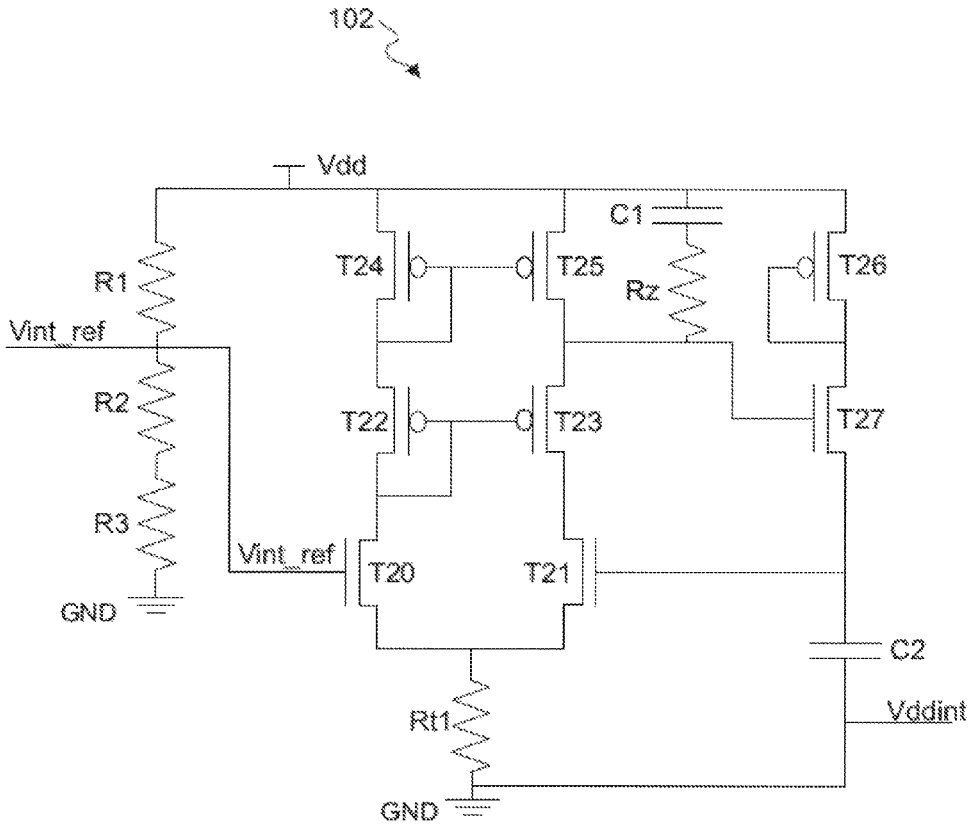
FIGS. 3A and 3B are schematic diagrams of a supply generator for use in the device of FIG. 1.

With reference to FIG. 3A, the intermediate supply generator 102 is now described in more detail. Resistors R1, R2, R3 are coupled in series between the power supply Vdd and ground GND as a voltage divider circuit, and the voltage drop across the resistors R2 and R3 is output from the intermediate supply generator 102 as the intermediate reference voltage Vint_ref. The intermediate supply generator 102 also includes transistors T20, T21, T22, T23, T24, T25, T26, and T27. Transistors T20, T21, T22, T23, and T27, as compensated by capacitor C1 and resistor Rz, are configured in a cascade structure to source an output current which flows through capacitor C2, to thereby generate the intermediate power supply voltage Vddint. Transistors T24, T25, and 26 are configured to protect the transistors T20, T21, T22, T23, and T27 from electrical stresses.

In more detail, the transistor T20 has a control terminal coupled to receive the intermediate reference voltage Vint_ref, a first conduction terminal coupled to the second conduction terminal and control terminal of the transistor T22, and a second conduction terminal coupled to ground GND via a tail resistor Rt1. The transistor T21 has a control terminal coupled between the second conduction terminal of transistor T27 and the capacitor C2, a first conduction terminal coupled to the second conduction terminal of the transistor T23, and a second conduction terminal coupled to ground GND via the tail resistor Rt1.

The transistor T22 has a control terminal coupled to its second conduction terminal, as well as to the first conduction terminal of the transistor T20. The first conduction terminal of the transistor T22 is coupled to the second conduction terminal of the transistor T24, as well as to the control terminal of the transistor T23. The transistor T23 has a first conduction terminal coupled to the second conduction terminal of the transistor T25.

The transistor T24 has a control terminal coupled to the control terminal of the transistor T25, as well as to the second conduction terminal of the transistor T24. The first conduction terminal of the transistor T24 is coupled to the power supply Vdd. The transistor T25 has a first conduction terminal coupled to the power supply Vdd.

The capacitor C1 and resistor Rz are coupled in series between the power supply Vdd and a node joining the second conduction terminal of the transistor T25, the first conduction terminal of the transistor T23, and the control terminal of the transistor T27. The transistor T26 has a first conduction terminal coupled to the power supply Vdd, and a second conduction terminal coupled to the first conduction terminal of the transistor T27 as well as to the control terminal of the transistor T26.

Figure 3B:
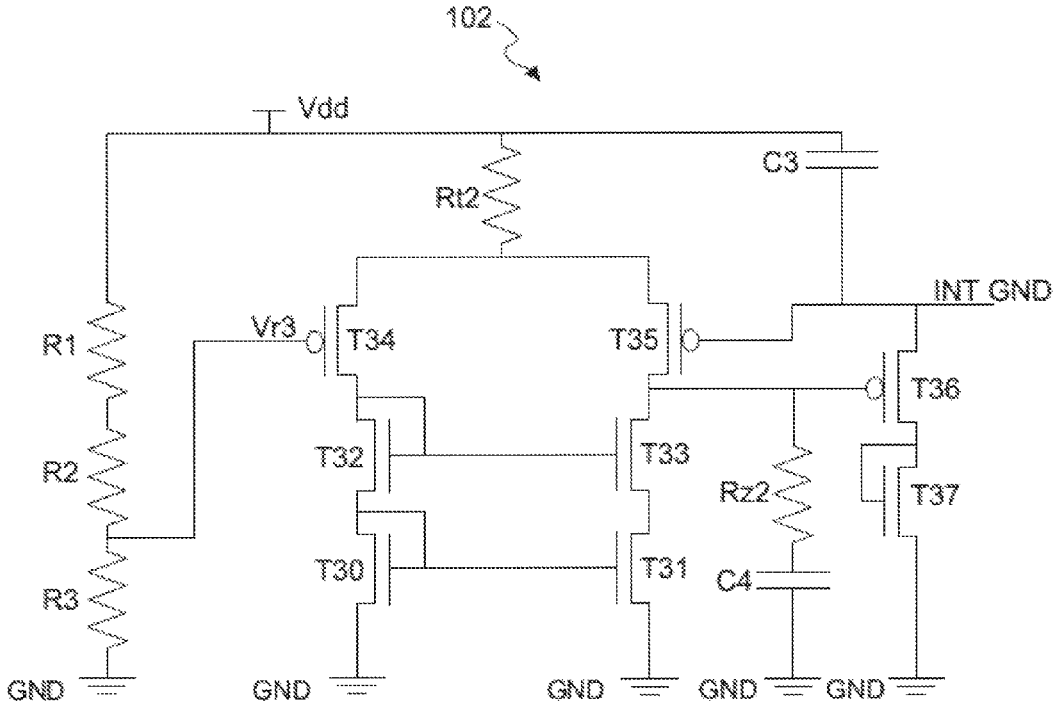

With reference to FIG. 3B, additional portions of the intermediate supply generator 102 are now described. Here, there are transistors T30, T31, T32, T33, T34, T35, T36, and T37. The transistors T32, T33, T34, T35, and T36, as compensated by resistor Rz2 and capacitor C4, are coupled in a cascade structure to source an output current which flows through a capacitor C3 to thereby generate the intermediate ground INT GND. The transistors T30, T31, and T37 are coupled to protect the transistors T32, T33, T34, T35, and T36 from electrical stresses.

In greater detail, the transistor T30 has a control terminal coupled to the control terminal of the transistor T31, as well as to the first conduction terminal of transistor T30 and second conduction terminal of transistor T32. The second conduction terminal of the transistor T30 is coupled to ground GND. The transistor T31 has a first conduction terminal coupled to the second conduction terminal of the transistor T33, and a second conduction terminal coupled to ground GND.

The transistor T32 has a control terminal coupled to the control terminal of the transistor T33 as well as to the first conduction terminal of the transistor T32 and the second conduction terminal of the transistor T34. The transistor T33 has a first conduction terminal coupled to the second conduction terminal of the transistor T35, to the resistor Rz2, and to the control terminal of the transistor T36.

The transistor T34 has a control terminal coupled between the resistor R3 and ground GND to receive the voltage Vr3, and a first conduction terminal coupled to the first conduction terminal of the transistor T36 and to the power supply Vdd through tail resistor Rt2. The transistor T35 has a control terminal coupled to the power supply Vdd through the capacitor C3, as well as to the first conduction terminal of the transistor T36.

The first conduction terminals of the transistors T34, T35 are coupled to the power source Vdd through the resistor Rt2.

The transistor T36 has a second conduction terminal coupled to the first conduction terminal and control terminal of the transistor T37. The second conduction terminal of the transistor T37 is coupled to ground GND.

The resistor Rz2 and capacitor C4 are coupled in series between a node joining the first conduction terminal of the resistor T33 and the control terminal of the transistor T36, and ground GND.

Those of skill in the art will appreciate that while the transistors described herein have been illustrated as field effect transistors in the drawing figures, they may in some applications instead be junction transistors. In addition, although certain transistors are illustrated as p-type transistors while other transistors are illustrated as n-type transistors, it should be understood that the p-type transistors can be replaced with n-type transistors, and vice versa, with minor changes to the connections thereof being made that will be understood by those of skill in the art.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. An electronic device, comprising:

a power supply node;

a ground node;

an intermediate ground node configured at a voltage between a voltage of the power supply node and a voltage at the ground node; and an error amplifier having an input stage coupled between the power supply node and the ground node, and an output stage coupled between the power supply node and the intermediate ground node;

wherein the output stage comprises:

a first output transistor having a first conduction terminal coupled to the power supply node, a second conduction terminal coupled to an output of the error amplifier, and a control terminal coupled to a first output of the input stage; and a second output transistor having a first conduction terminal coupled to the intermediate ground node, a second conduction terminal coupled to the output of the error amplifier, and a control terminal coupled to a second output of the input stage.

2. The electronic device of claim 1, further comprising:

wherein the error amplifier has a first input coupled to receive a reference voltage, and a second input coupled to receive an intermediate reference voltage;

wherein the error amplifier is switchable between:

a startup mode wherein the error amplifier is configured to generate an output in response to the intermediate reference voltage at the second input, and a normal operation mode wherein the error amplifier is configured to generate the output in response to the reference voltage at the first input.

3. The electronic device of claim 2, further comprising a reference voltage generator configured to generate the reference voltage, and an intermediate reference voltage generator configured to generate an intermediate reference voltage.

4. The electronic device of claim 3, wherein the reference voltage generator comprises a bandgap voltage reference circuit; and wherein the reference voltage is temperature independent.

5. The electronic device of claim 4, wherein the bandgap voltage reference circuit is configured to output a control signal to indicate that the startup mode is to end and that the normal operation mode is to begin.

6. The electronic device of claim 4, further comprising a logic block coupled to the bandgap voltage reference circuit and to the error amplifier, the logic block configured to switch the error amplifier between the startup mode and the normal operation mode based upon the control signal from the bandgap voltage reference circuit.

7. The electronic device of claim 2, wherein a voltage of the output generated when the error amplifier is in the normal operation mode is greater than a voltage of the output generated when the error amplifier is in the startup mode.

8. The electronic device of claim 2, further comprising a ballast transistor having a control terminal coupled to receive the output of the error amplifier.

9. The electronic device of claim 8, further comprising a feedback circuit configured to generate first and second feedback voltages; wherein the ballast transistor has a conduction terminal coupled to the feedback circuit; wherein the error amplifier operates in response to the first feedback voltage during the startup mode; and wherein the error amplifier operates in response to the second feedback voltage during the normal operation mode.

10. The electronic device of claim 9, wherein the error amplifier comprises:

a first differential input stage having differential inputs coupled to receive the reference voltage and the second feedback voltage, and having a first tail;

a second differential input stage having differential inputs coupled to receive the intermediate reference voltage and the first feedback voltage, and having a second tail;

a first switch configured to couple the first tail of the first differential input stage to the ground node when in the normal operation mode and to decouple the first tail of the first differential input stage from the ground node when in the startup mode; and a second switch configured to selectively couple the second tail of the second differential input stage to the ground node when in the startup mode and to decouple the first tail of the second differential input stage from the ground node when in the normal operation mode.

11. The electronic device of claim 10, wherein the first tail of the first differential input stage comprises a current source; and wherein the second tail of the second differential input stage comprises a tail resistor.

12. The electronic device of claim 11, wherein the first differential input stage comprises:

a first transistor having a control terminal coupled to receive the reference voltage, a first conduction terminal, and a second conduction terminal coupled to the current source; and a second transistor having a control terminal coupled to receive the second feedback voltage, a first conduction terminal, and a second conduction terminal coupled to the current source and to the second conduction terminal of the first transistor.

13. The electronic device of claim 12, wherein the second differential input stage comprises:

a third transistor having a first conduction terminal, a second conduction terminal coupled to the tail resistor, and a control terminal coupled to receive the intermediate reference voltage; and a fourth transistor having a first conduction terminal, a second conduction terminal coupled to the tail resistor, and a control terminal coupled to receive the first feedback voltage.

14. The electronic device of claim 13, wherein the error amplifier further comprises:

a fifth transistor having a first conduction terminal, a second conduction terminal coupled to the first conduction terminal of the first transistor, and a control terminal coupled to receive a biasing voltage; and a sixth transistor having a first conduction terminal, a second conduction terminal coupled to the first conduction terminal of the second transistor, and a control terminal coupled to receive the biasing voltage and to the control terminal of the third transistor.

15. The electronic device of claim 14, wherein the output stage is coupled to the first and second differential input stages; and wherein the output stage comprises:

a seventh transistor having a first conduction terminal, a second conduction terminal coupled to the intermediate ground node, and a control terminal coupled to the first conduction terminal of the seventh transistor;

wherein the control terminal of the second output transistor is coupled to the control terminal of the seventh transistor; and an eighth transistor having a first conduction terminal coupled to the power supply node, a second conduction terminal coupled to the first conduction terminal of the seventh transistor, and a control terminal coupled to the second output of the input stage.

16. The electronic device of claim 10, wherein the first tail of the first differential input stage comprises a current source; and wherein the second tail of the second differential input stage comprises a tail resistor.

17. The electronic device of claim 10, wherein the output stage is coupled to the first and second differential input stages.

18. The electronic device of claim 1, wherein the electronic device comprises one of a cellular phone and a tablet.

19. A method of operating an electronic device, comprising:

operating an error amplifier in a startup mode with inputs receiving an intermediate reference voltage and a first feedback voltage to generate an output signal based on a difference between the intermediate reference voltage and the first feedback voltage;

operating the error amplifier in a normal operation mode with inputs receiving a reference voltage and a second feedback voltage to generate the output signal based on a difference between the reference voltage and the second feedback voltage; and driving a transistor of a low dropout amplifier with the output signal to generate an output voltage.

20. The method of claim 19, further comprising referencing the output signal to a raised ground reference relative to a ground reference for the output voltage of the low dropout amplifier.

21. The method of claim 19, further comprising sensing when the reference voltage reaches a threshold voltage, and switching the error amplifier from the startup mode to the normal operation mode based thereupon.

22. The method of claim 19, further comprising generating the first and second feedback voltages from the output voltage.

23. An electronic device, comprising:

a power supply node;

a ground node;

an intermediate ground node; and an error amplifier having an input stage coupled between the power supply node and the ground node, and an output stage coupled between the power supply node and the intermediate ground node;

wherein the error amplifier is switchable between:

a startup mode wherein the error amplifier is configured to operate in response to an intermediate reference voltage from the intermediate ground node, and a normal operation mode wherein the error amplifier is configured to operate in response to a reference voltage from the ground node;

wherein the error amplifier comprises:

a first input stage having inputs coupled to receive the reference voltage and a second feedback voltage, and having a first tail, a second input stage having inputs coupled to receive the intermediate reference voltage and a first feedback voltage, and having a second tail, switch circuitry configured to selectively couple the first and second tails to and from the ground node as a function of the error amplifier being in the startup mode or the normal operation mode.

24. The electronic device of claim 23, further comprising a reference voltage generator configured to generate the reference voltage, and an intermediate reference voltage generator configured to generate the intermediate reference voltage.

25. The electronic device of claim 23, wherein a voltage of an output generated when the error amplifier in the normal operation mode is greater than a voltage of an output generated when the error amplifier is in the startup mode.

26. The electronic device of claim 23, further comprising a ballast transistor having a control terminal coupled to be controlled by the error amplifier.

27. The electronic device of claim 26, further comprising a feedback circuit configured to generate the first and second feedback voltages; wherein the ballast transistor is controlled by the feedback circuit; wherein the error amplifier selectively operates in response to the first and second feedback voltages as a function of being in the startup mode or the normal operation mode.

28. The electronic device of claim 23, wherein the first tail comprises a current source; and wherein the second tail comprises a tail resistor.

* * * * *